US010244804B2

(12) United States Patent
Hodgson et al.

(10) Patent No.: US 10,244,804 B2
(45) Date of Patent: Apr. 2, 2019

(54) GARMENT VENT

(71) Applicant: Berghaus Limited, London (GB)

(72) Inventors: James Hodgson, London (GB); Marian Barnes, London (GB); Gary Martin, London (GB)

(73) Assignee: BERGHAUS LIMITED, London (GB)

( * ) Notice: Subject to any disclaimer, the term of this patent is extended or adjusted under 35 U.S.C. 154(b) by 1024 days.

(21) Appl. No.: 13/893,885

(22) Filed: May 14, 2013

(65) Prior Publication Data

US 2013/0333092 A1 Dec. 19, 2013

(30) Foreign Application Priority Data

May 14, 2012 (GB) ..... 1208562.7

(51) Int. Cl.

| | |
|---|---|
| ***A41D 13/012*** | (2006.01) |
| ***A41D 3/04*** | (2006.01) |
| ***A41B 1/08*** | (2006.01) |
| ***A41D 27/28*** | (2006.01) |

(52) U.S. Cl.

CPC ..... *A41D 3/04* (2013.01); *A41D 27/28* (2013.01); *A41D 27/285* (2013.01)

(58) Field of Classification Search

CPC . A41D 3/00; A41D 3/04; A41D 27/28; A41D 27/285; A41D 2400/20; Y10S 2/01; Y10S 2/05

USPC ... 2/82, 85, 87, 93, 108, DIG. 1, 1, 97, 115, 2/121, DIG. 5

See application file for complete search history.

(56) References Cited

U.S. PATENT DOCUMENTS

| | | | | | |
|---|---|---|---|---|---|
| 422,917 | A * | 3/1890 | Chase | A41D 3/04 | 2/87 |
| 1,092,105 | A * | 3/1914 | Holmes | A41D 1/04 | 192/113.1 |
| 1,252,187 | A | 1/1918 | Shane | | |
| 1,732,369 | A * | 10/1929 | Leeman | A41H 1/10 | 2/93 |
| 2,084,173 | A * | 6/1937 | Wexler | A41D 27/28 | 2/87 |

(Continued)

FOREIGN PATENT DOCUMENTS

| | | |
|---|---|---|
| DE | 93 18 838 | 2/1994 |
| DE | 203 08 074 | 8/2003 |

(Continued)

OTHER PUBLICATIONS

English machine translation of "JP H07278913 A" via JPO translation website (URL: https://dossier1.j-platpat.inpit.go.jp/tri/all/odse/ODSE_GM101_Top.action). Accessed Feb. 26, 2016.*

(Continued)

*Primary Examiner* — Jameson D Collier

(74) *Attorney, Agent, or Firm* — Marvin Petry; Stites & Harbison PLLC

(57) ABSTRACT

A garment having a vent which has an upper panel and a lower panel, wherein the upper panel has a lower end portion and the lower panel has an upper end portion, and the lower end portion of the upper panel overlaps the upper end portion of the lower panel to form an opening, wherein the vent further has a gutter extending into the opening to trap rain travelling through the opening.

15 Claims, 13 Drawing Sheets

(56) References Cited

U.S. PATENT DOCUMENTS

| | | | | | |
|---|---|---|---|---|---|
| 2,259,560 | A * | 10/1941 | Glidden | A41D 27/28 | 156/253 |
| 2,631,290 | A * | 3/1953 | Klepper | A41D 27/28 | 2/87 |
| 2,647,261 | A * | 8/1953 | Rassner | A41D 1/04 | 2/115 |
| 2,697,832 | A * | 12/1954 | Stich | A41D 31/00 | 2/243.1 |
| 2,771,661 | A * | 11/1956 | Foster | A41D 31/02 | 2/87 |
| 3,045,243 | A * | 7/1962 | Lash | A41D 27/28 | 2/1 |
| 3,086,215 | A * | 4/1963 | Di Paola | A41D 27/28 | 2/87 |
| 3,213,465 | A * | 10/1965 | Ludwikowski | A41D 27/28 | 2/237 |
| 3,296,626 | A * | 1/1967 | Ludwikowski | A41D 27/28 | 2/87 |
| 4,408,356 | A * | 10/1983 | Abrams | A41D 27/28 | 2/87 |
| 4,576,087 | A * | 3/1986 | Wolfe | A41D 27/28 | 2/87 |
| 4,576,807 | A | 3/1986 | Loechelt, II | | |
| 4,731,883 | A * | 3/1988 | Foster | A41D 27/28 | 2/247 |
| 5,269,862 | A * | 12/1993 | Nakajima | A01G 9/1438 | 156/155 |
| 5,511,246 | A | 4/1996 | Farkas et al. | | |
| 5,603,646 | A | 2/1997 | Tobias | | |
| 5,642,526 | A | 7/1997 | Thompson | | |
| 5,687,423 | A * | 11/1997 | Ross | A41D 27/28 | 2/70 |
| 5,727,256 | A | 3/1998 | Rudman | | |
| 5,845,336 | A | 12/1998 | Golde | | |
| 6,052,826 | A | 4/2000 | Tolton | | |
| 6,085,353 | A | 7/2000 | Van Der Sleesen | | |
| 6,163,883 | A | 12/2000 | Hong | | |
| 6,260,196 | B1 | 7/2001 | Van Der Sleesen | | |
| 6,263,510 | B1 | 7/2001 | Bay et al. | | |
| 6,263,511 | B1 | 7/2001 | Moretti | | |
| 6,272,684 | B1 | 8/2001 | Shih | | |
| 6,339,845 | B1 | 1/2002 | Burns et al. | | |
| 6,421,834 | B2 | 7/2002 | Kester | | |
| 6,442,760 | B2 | 9/2002 | Moretti | | |
| 6,571,432 | B1 | 6/2003 | Rindle | | |
| 6,651,254 | B1 | 11/2003 | Chang | | |
| 6,668,384 | B1 | 12/2003 | Chang | | |
| 6,792,621 | B2 | 9/2004 | Braun | | |
| 6,795,976 | B1 | 9/2004 | Van Der Sleesen | | |
| 6,845,517 | B2 | 1/2005 | Aldridge et al. | | |
| 7,003,805 | B1 | 2/2006 | Woodfork, Jr. | | |
| 7,043,767 | B2 | 5/2006 | Jaeger | | |
| 7,171,695 | B2 | 2/2007 | Braun | | |
| 7,378,141 | B2 | 5/2008 | Polegato Moretti | | |
| 7,404,214 | B2 | 7/2008 | Woolcott et al. | | |
| 7,412,728 | B2 | 8/2008 | Alesina et al. | | |
| 7,540,037 | B1 | 6/2009 | Bittler et al. | | |
| 7,713,370 | B2 | 5/2010 | Polegato Moretti | | |
| 7,770,234 | B2 | 8/2010 | Roux et al. | | |
| 7,966,668 | B2 | 6/2011 | Bay | | |
| 8,001,618 | B2 | 8/2011 | Bay | | |
| 8,011,028 | B2 | 9/2011 | Grilliot et al. | | |
| 9,309,689 | B2 * | 4/2016 | Fier | E04H 15/16 | |
| 2002/0124296 | A1 | 9/2002 | Lipsett et al. | | |
| 2003/0033656 | A1 * | 2/2003 | Jaeger | A41D 27/28 | 2/69 |
| 2004/0128735 | A1 | 7/2004 | Golde | | |
| 2004/0133962 | A1 | 7/2004 | Baumel | | |
| 2005/0273903 | A1 | 12/2005 | Rudman | | |
| 2006/0059601 | A1 | 3/2006 | Opitz et al. | | |
| 2006/0185053 | A1 | 8/2006 | Wittmann et al. | | |
| 2007/0271669 | A1 | 11/2007 | Bansal et al. | | |
| 2008/0127395 | A1 | 6/2008 | Blauer et al. | | |
| 2008/0196140 | A1 | 8/2008 | Mayerson et al. | | |
| 2008/0263743 | A1 | 10/2008 | Maurer | | |
| 2009/0000006 | A1 | 1/2009 | Mitchell | | |
| 2009/0186548 | A1 | 7/2009 | Rock et al. | | |
| 2009/0265829 | A1 | 10/2009 | Gomes Seguin et al. | | |
| 2009/0293171 | A1 | 12/2009 | Fayle et al. | | |
| 2010/0011480 | A1 | 1/2010 | Carter | | |
| 2010/0199404 | A1 | 8/2010 | Garza | | |
| 2010/0212061 | A1 | 8/2010 | Luciano | | |
| 2010/0242149 | A1 | 9/2010 | Mickle et al. | | |
| 2010/0269245 | A1 | 10/2010 | Stubiger | | |
| 2010/0281597 | A1 | 11/2010 | Lang | | |
| 2010/0320241 | A1 | 12/2010 | Thompson | | |
| 2011/0214218 | A1 | 9/2011 | Bonamer et al. | | |
| 2012/0017346 | A1 | 1/2012 | Reimer | | |
| 2012/0060256 | A1 | 3/2012 | Parker | | |

FOREIGN PATENT DOCUMENTS

| | | | | | |
|---|---|---|---|---|---|
| DE | 203 06 922 | | 9/2004 | | |
| EP | 0 581 186 | | 2/1994 | | |
| EP | 1 518 472 | | 3/2005 | | |
| EP | 1 778 032 | | 10/2011 | | |
| FR | 375439 | A * | 7/1907 | A41D 27/28 | |
| FR | 383578 | A * | 3/1908 | A41D 27/28 | |
| FR | 867813 | A * | 11/1941 | A41D 27/28 | |
| FR | 2619997 | A1 * | 3/1989 | A41D 27/28 | |
| FR | 2633493 | A3 * | 1/1990 | A41D 3/005 | |
| GB | 114596 | | 4/1918 | | |
| GB | 543509 | A * | 3/1942 | A41D 27/28 | |
| GB | 2104770 | A * | 3/1983 | A41D 27/28 | |
| GB | 2 327 858 | | 2/1999 | | |
| GB | 2 405 782 | | 3/2005 | | |
| JP | 7-157908 | | 6/1995 | | |
| JP | 7-278913 | | 10/1995 | | |
| JP | 2607057 | | 10/1996 | | |
| JP | 09-078316 | | 3/1997 | | |
| JP | 11-061535 | | 3/1999 | | |
| JP | 2001-140114 | | 5/2001 | | |
| JP | 2002-088532 | | 3/2002 | | |
| JP | 2002-146604 | | 5/2002 | | |
| JP | 2002-161406 | | 6/2002 | | |
| JP | 2005-163227 | | 6/2005 | | |
| JP | 3136886 | U | 11/2007 | | |
| JP | 2008-013861 | | 1/2008 | | |
| JP | 3148977 | | 12/2008 | | |
| JP | 2009299251 | | 12/2009 | | |
| JP | 2010-163701 | | 7/2010 | | |
| JP | 2010-186041 | | 8/2010 | | |
| JP | 2010-216069 | | 9/2010 | | |
| JP | 2011-006818 | | 1/2011 | | |
| JP | 2011-080166 | | 4/2011 | | |
| JP | 2011-117121 | | 6/2011 | | |
| WO | WO 91/03956 | | 4/1991 | | |
| WO | WO 2011/047701 | | 4/2011 | | |

OTHER PUBLICATIONS

English machine translation of FR 383,578 A (Veillon, Paul-Henri-Joseph) via espacenet.com.*

GB Search Report for Application No. GB1208562.7 dated Aug. 23, 2012.

Examination Report under Section 18(3), Application No. GB 120856237, dated: Sep. 2, 2016, 4 pages.

Examination Report under Section 18(3), Application No. GB 120856237, dated: Jan. 11, 2017.

International Search Report and the Written Opinion of the International Searching Authority, Appln. No. PCT/GB2013/051240, dated: May 14, 2013, 15 pages.

* cited by examiner

GARMENT VENT

This invention has to do with vents for garments, particularly to do with open vents that do not require a zipper or other closing means to remain waterproof.

BACKGROUND

In weatherproof garments such as coats and jackets, it is conventional to have one or more vents. The function of the vents is to allow air to flow into the garment to cool the user.

However, with such weatherproof garments, it is desirable for the vent to be waterproof, so that the garment may be classified to have a certain degree of waterproof integrity (e.g. GORE-TEX® storm level testing/GQS2). Commonly, waterproof vents achieve this by providing zippers or similar closure means that the user has to close in order to render the vent weatherproof. This is disadvantageous as it means that the vent cannot be acting to cool the user whilst closed. Users who participate in activities such as mountaineering, hill walking, cycling and running have to choose between having the vent open and risking getting wet through the vent, or having the vent closed to stay dry but getting hot due to the closed vent.

Vents such as these are also disadvantageous because they require the user to remember to close and open the vent when it starts or stops raining, or when ventilation is required.

Some vent arrangements have been designed to overcome this problem. These vents commonly have a mesh or similar material that extends across the vent opening, to allow the free flow of air into the garment and inhibit the passage of water, e.g. rain, through the vent and into the garment. In many cases, the mesh also acts to hold the vent together, performing a structural function.

For example, U.S. Pat. No. 7,043,767 discloses such a ventilation system for waterproof sports clothing. In this document, ventilation openings are provided which are formed by overlaps of the material of the clothing. These ventilation openings are waterproof due to the presence of a flexible, three-dimensionally cross-linked spacer material filling the opening that acts as a barrier to water.

JP 2009299251 also discloses a similar opening to that of U.S. Pat. No. 7,043,767. A cloth piece is connected by stitching to both sides of the opening to act as a rainwater invasion preventing dam.

Alternative vent arrangements have also been designed to overcome the problem of providing an open but waterproof vent that does not require a spacer or mesh material to block the vent opening, e.g. JP 3136886U. In this document, a raincoat is formed from a waterproof outer material and an inner material. The inner material may be made of a mesh cloth that is stretchable. A ventilation opening is formed by an overhang between an upper part and a lower part of the outer material. At the overhang, the upper end portion of the lower part of the outer material is fastened to the inner material, creating a meshed vent. The length of the overlap being about 50 mm helps to prevent water from entering into the inside of the raincoat.

JP-A-7278913 also discloses a similar arrangement. However, in this document there is a special configuration to trap water. This is located in the overhang at the top of the upper end portion of the lower part of the outer material, just before the outer material joins the (meshed) inner material. The configuration consists of an upper end portion of the lower part of the material folded four times to a form a four-layer part with two V-shaped grooves. This is fastened integrally with the same stitches that join the lower part of the outer material to the inner mesh. This arrangement is designed so that when a wearer bends over, the ventilation opening narrows and the lower portion of the upper end part of the outer material touches the V-shaped grooves to block water travelling into the ventilation opening. This prevents water running along the outer material into the ventilation opening when the user bends over.

SUMMARY OF INVENTION

In general terms, the present invention relates to a new vent or series of vents for garments e.g. weatherproof jackets, trousers, shorts, hats or the like. The vent of the present invention has a gutter formation in the vent opening, which enables the vent to remain open and yet maintain its weatherproof integrity (e.g. to GORE-TEX® GQS2/Storm level testing which simulates wind-blown rain and extreme weather conditions). It can remain permanently open and has the ability to remain waterproof even whilst open. It also does not require zippers or similar closure means to remain waterproof, nor does it require a mesh panel or other similar material known in the art to be located between the two panels to act as e.g. spacers, fillers or attachment means for the two panels, to extend across the entire depth of the vent opening and act as a barrier to water.

In one aspect, the invention provides a vent for garments, preferably weatherproof garments (e.g. waterproof garments), comprising an upper panel and a lower panel, wherein the upper panel has a lower end portion and the lower panel has an upper end portion, and the lower end portion of the upper panel overlaps the upper end portion of the lower panel to form an opening, wherein the vent further comprises a gutter extending into the opening to trap rain travelling through the opening.

The gutter can be formed by folding over the top end of the upper end portion of the lower panel. By folding the upper end of the lower panel over towards the upper panel, so that it extends partially across the vent opening, it can form a downwardly opening channel (i.e. gutter) that can catch wind-blown rain water that would otherwise pass through the vent.

The gutter may also be formed by forming a double fold in the lower end portion of the upper panel.

Alternatively, a gutter may be formed by fastening material to one of the surfaces of the upper or lower panels facing the opening. The material may be e.g. bonded or stitched to the upper or lower panels. The skilled person will appreciated that other attachment means may be employed.

The length of the material forming the gutter (i.e. the gutter length) is preferably at least 5 mm, more preferably at least 10 mm, and even more preferably at least 15 mm. The gutter length is preferably at most 50 mm.

The gutter preferably forms an acute angle of less than 85°, more preferably less than 45°, even more preferably less than 30°. Preferably the end of the gutter is spaced from the panel across substantially the majority of the vent. However, it will be understood by the skilled person that when the garment is in active use by the user that the gutter may bend and the angle formed by the gutter will vary.

Preferably the length of the overlap between the upper panel and the lower panel is at least 30 mm, more preferably at least 40 mm, and even more preferably at least 50 mm. Preferably the length of the overlap is at most 250 mm.

The upper and lower panels may be attached at regular intervals at discrete points using bartacks or other similar attachment means commonly known in the art. These discrete points may be points of stress in the material when the garment is in active use.

However, in some embodiments, the vent need not have any intermediary attachment points between the upper and lower panels along the width of the vent.

The gutter may be stitched or bonded at discrete points, for example where the upper panel and the lower panel are attached. This helps to retain the form of the gutter. Preferably the gutter is only stitched or bonded at the edges of the vent.

Preferably the gutter is free from obstruction. Preferably the gutter also extends partially across the depth of the opening when the garment is in use, so that a passage of air can still flow between the gutter and the inner surface of the upper panel.

Preferably the opening between the gutter and the upper panel is substantially un-obstructed by any spacer or mesh material, or any other similar material, that act either to attach the upper and lower panels, or to filter air entering the opening to prevent the ingress of wind-blown rain or moisture.

The gutter preferably extends across the majority of the depth of the opening towards the upper panel when in active use. The depth is the spacing between the panels at the overlap. Preferably the gutter also extends across at least the majority of the width of the vent.

The free end of the upper or lower panel may have a hem. In some embodiments both the upper and lower panels have a hem. A hem is a small fold at the end of the material that is stitched or bonded back on itself and serves as a way to terminate a length of fabric to create an edge that is less likely to fray. The hems in garments of the present invention may be stitched or bonded. If hems are to be used, an additional material allowance is required for these. The hem for the lower panel may be located at the end of the gutter, so that the lower panel has a gutter and a hem.

In some fabrics, particularly those of three layer construction with a woven or knitted face fabric, a waterproof breathable membrane and a warp knitted backer fabric, for example GORE-TEX® Active, it has been found that the inner surface of the fabric wicks water significantly and it is preferable to use a wicking barrier, such as a polyurethane adhesive tape.

Preferably both of the upper and lower panels have a wicking barrier. Alternatively only one of the upper panel or the lower panel may have a wicking barrier. This barrier may be e.g. a tape, film, adhesive, cement or print. The wicking barriers may be made from e.g. pre-made tapes, PTFE, PU, TPU, silicon and rubber. The wicking barrier is preferably located within the overlap between the upper and lower panels, on the surfaces of the panels facing the opening. The wicking barrier is preferably located on the backer of the upper layer facing the opening and on the gutter of the lower layer facing the opening. The function of the wicking barrier is to prevent any additional moisture in the vents soaking into the backer material of the fabric of the body panels and wicking/soaking up the fabric and through the opening.

In fabrics that do not wick on the inner surface, particularly those of two layer construction with a woven or knitted face fabric and a waterproof breathable membrane or coating, for example GORE-TEX® Paclite, a wicking barrier is generally not required.

In a further aspect, the invention provides a garment comprising a vent or series of vents in accordance with any of the aspects above. The garment may be a coat or a jacket, for example a weatherproof jacket. The garment may alternatively be trousers or a hat, shorts or other weather wear items. The skilled person will understand that the vent of the present invention will be applicable to a variety of garments. Taking the example of a waterproof jacket, the vents may be located on the chest, side, front, hood, shoulders, sleeves or back of the garment. A garment may comprise, for example, a series of parallel vents adjacent to one another (e.g. one above the other) to form a gill-like pattern. The skilled person will understand that other locations may be suitable for the vents.

The invention also provides for a method of construction of a vent for garments, including the steps of providing an upper panel and a lower panel with an overlap to create an opening, and forming a gutter by folding over a length of the top end of the lower panel to create an acute angle between the fold and lower panel, so that it extends into and partially across the opening.

BRIEF DESCRIPTION OF FIGURES

An example is now described with reference to the accompanying drawings, in which.

DETAILED DESCRIPTION

Figure 1:
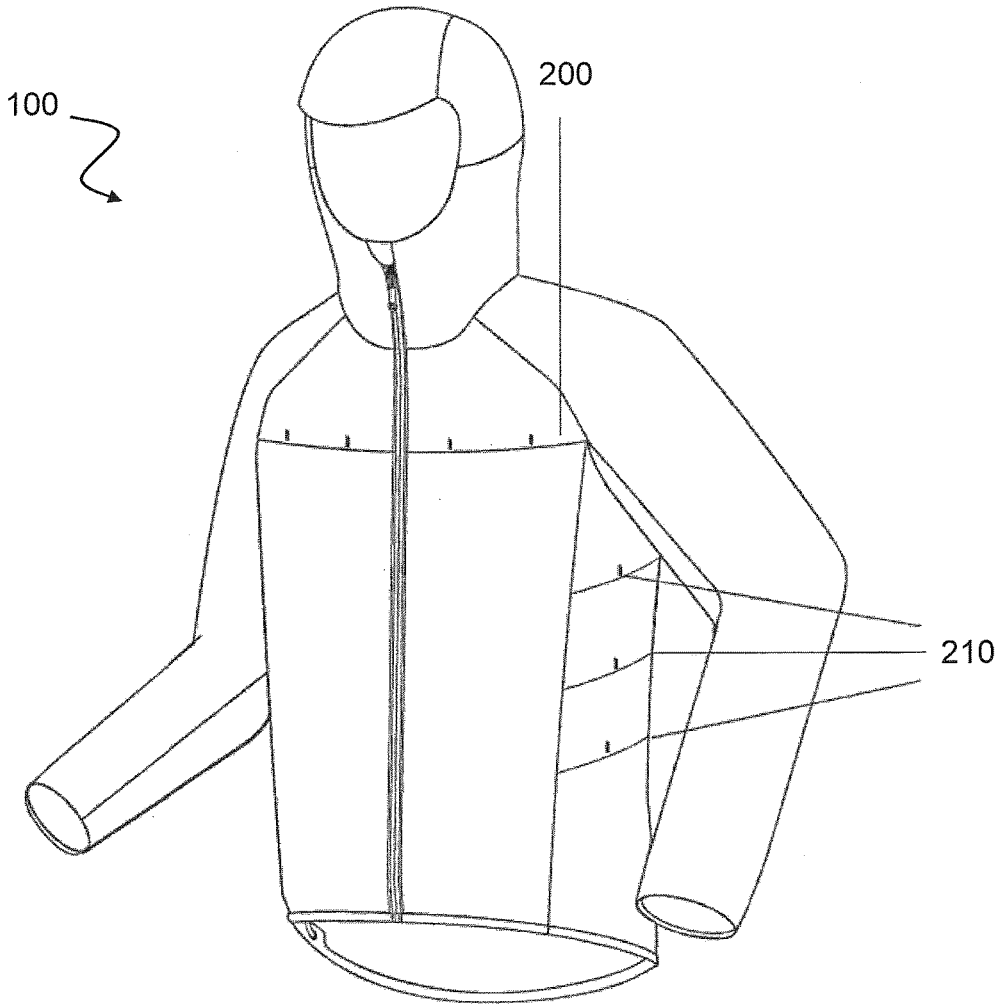
FIG. 1 illustrates an example of a waterproof rainwear garment utilising the vent of an embodiment of the present invention.
Figure 2:
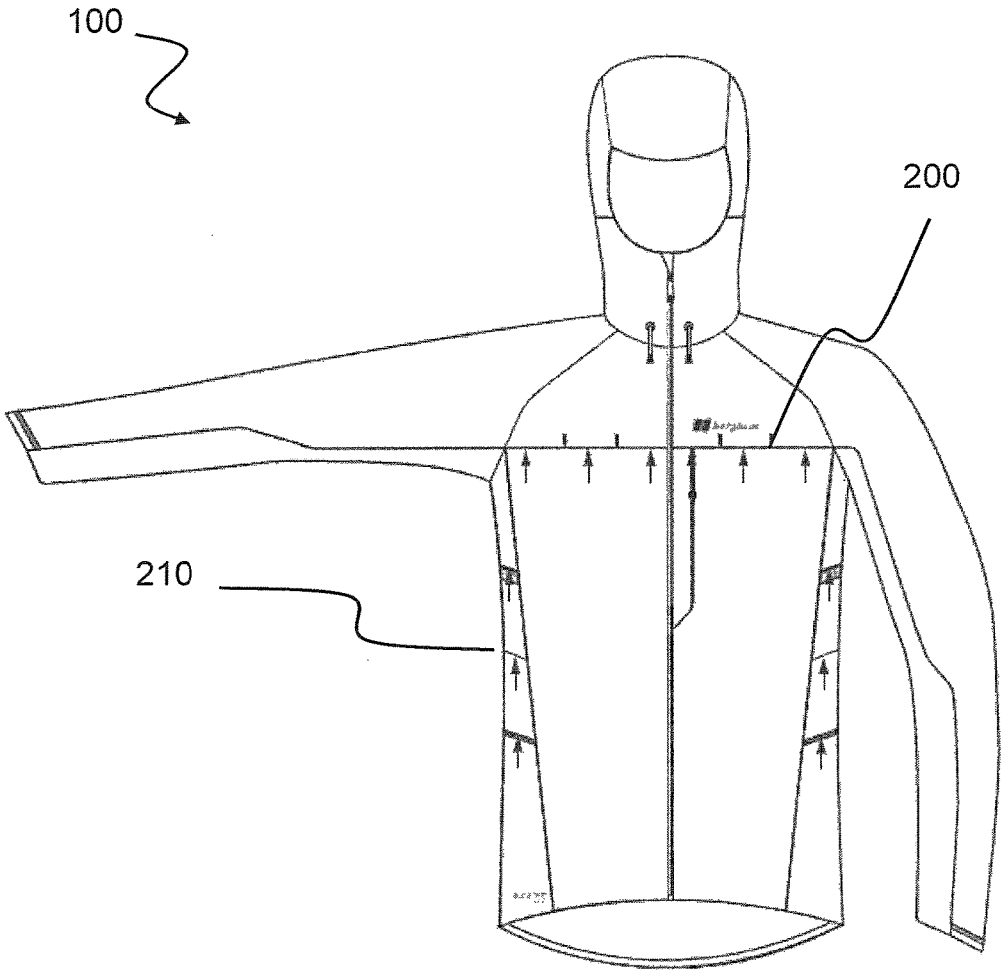
FIG. 2 illustrates a front view of an example of a waterproof rainwear garment utilising the vent of an embodiment of the present invention.
Figure 3:
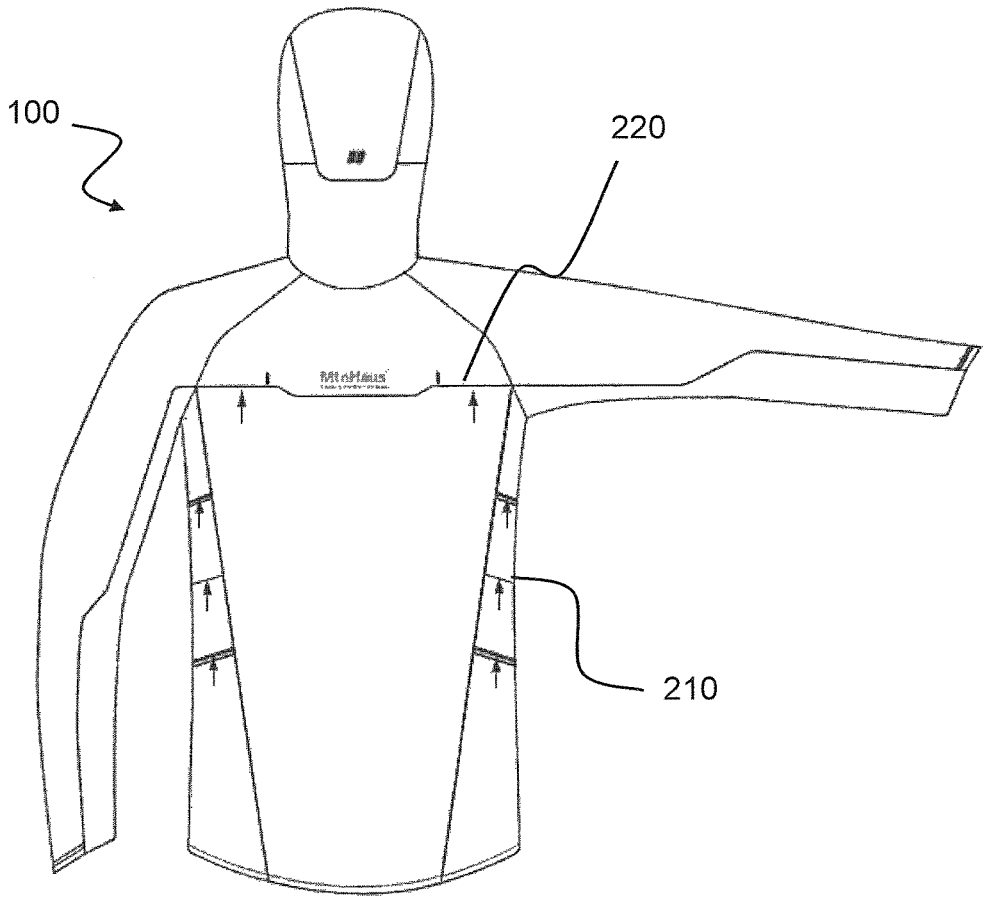
FIG. 3 illustrates a rear view of an example of a waterproof rainwear garment utilising the vent of an embodiment of the present invention.

An example of a garment including the vent of the present invention is illustrated in FIGS. 1-4. FIGS. 1 and 2 illustrate a weatherproof jacket 100, which in this example is waterproof, having a plurality of chest vents 200 and a plurality of side vents 210, the plurality of side vents forming a gill-like configuration. FIG. 3 additionally illustrates the location of rear vents 220 as well as side vents 210. It will be understood by the skilled person that vents may be located at other locations in the jacket, such as on the arms of the garment. The skilled person will also understand that only one vent or a plurality of vents may be used. The present invention is particularly suited for garments used by active individuals engaged in activities such as mountaineering, climbing, hiking, cycling, running or motorbiking.

Figure 4:
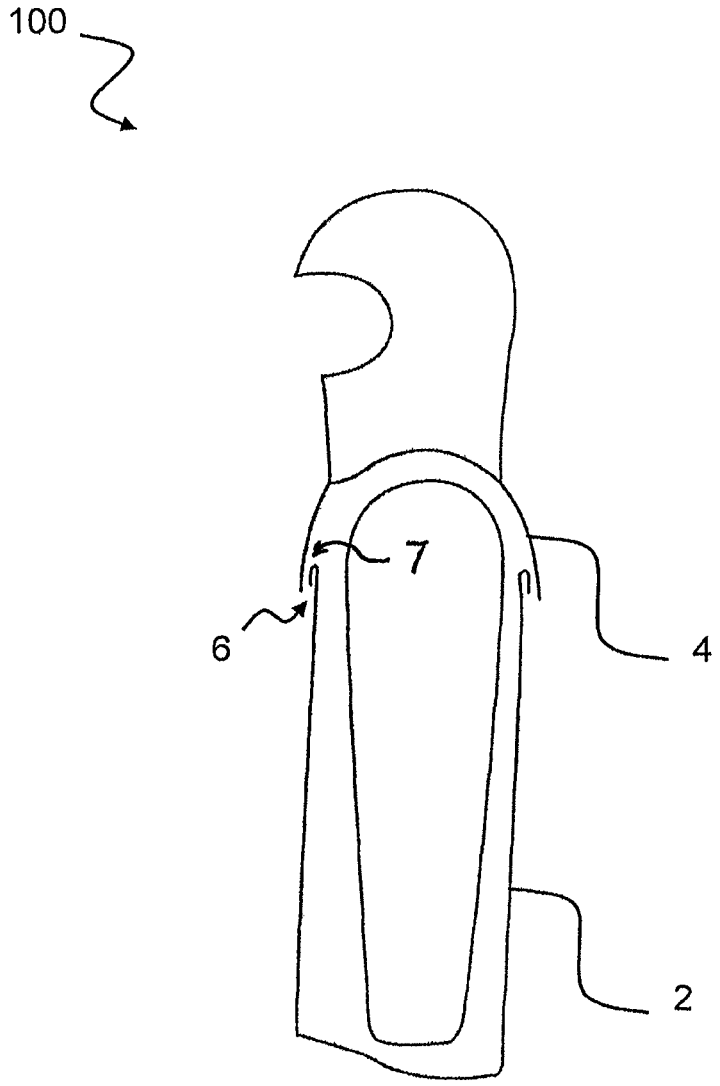
FIG. 4 illustrates a side view of an example of a waterproof rainwear garment utilising the vent of an embodiment of the present invention showing the overlap between the upper and lower panel, the opening and the gutter.

A side view of an embodiment of the illustration is illustrated in FIG. 4. This shows the overlap between the upper outer panel 4 and lower inner panel 2, and the opening 6. An access opening 7 is shown above the top of the inner panel into the interior of the garment. The jacket 100 includes an outside defined by the outer surface of panel 4 and the outer surface of the panel 2 below the panel 4 and an interior shown at 5 in FIG. 4 which is a space adjacent the body of a wearer of the jacket.

Figure 5:
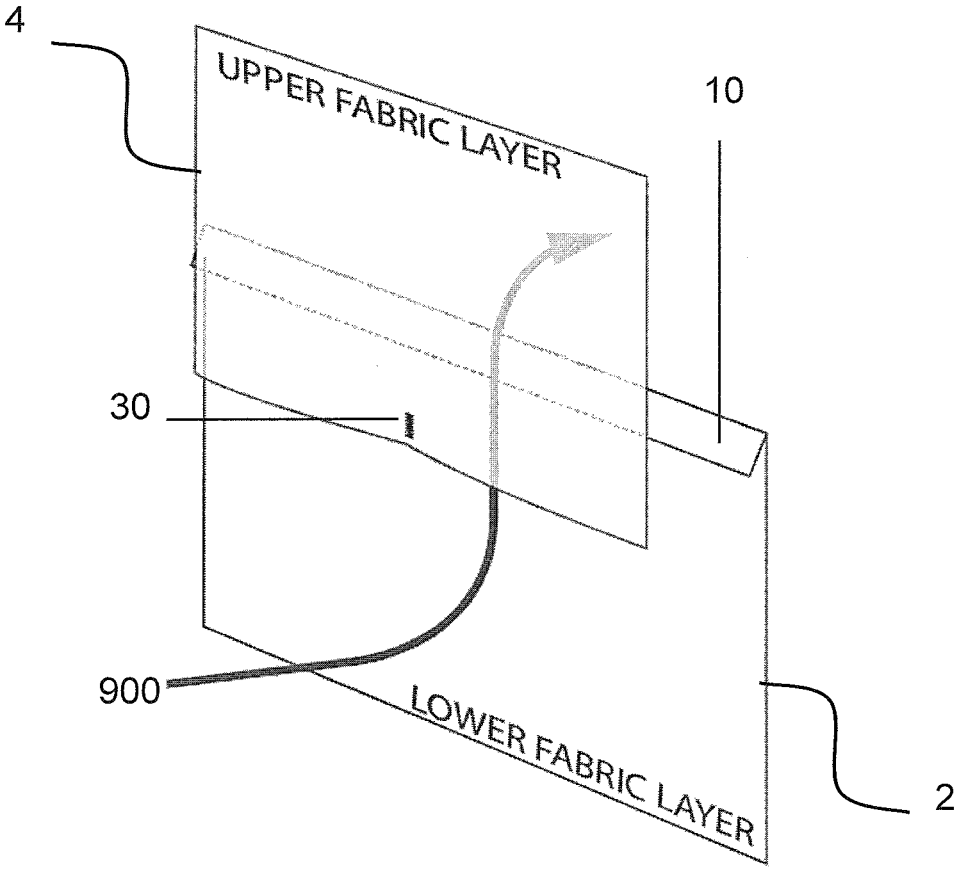
FIG. 5 illustrates a perspective view of the overlap between the upper layer and the lower layer, the opening and the gutter.

A perspective view of an embodiment of the invention is illustrated in FIG. 5. FIG. 5 illustrates lower panel 2 and upper panel 4 that overlap to form the vent. The lower panel 2 and upper panel 4 may be constructed from the same material, preferably a waterproof but breathable material (e.g. GORE-TEX®). The skilled person will understand that other types of material can be used.

In the embodiment of the invention illustrated by FIG. 5, the panels are attached using a bartack 30. The skilled person will understand that other attachment means commonly used in the art, e.g. rivets or bonding/adhesives may also be used.

In this embodiment of the present invention, an opening is created between the panels allowing air flow 900 through the opening. The upper end portion of the lower panel is folded over to create a gutter 10. In this example, the gutter extends along the entire width of the opening. The gutter preferably extends across the majority of the depth of the opening towards the upper panel when in use. The depth is the spacing between the upper and lower panels at the overlap. Preferably the gutter 10 is unobstructed to provide an open channel that can catch wind-blown rain water. That is, no material such as a spacer or mesh material lies in the gutter. Additionally, the opening 6 forms an unobstructed vent path from outside of the jacket, through the vent opening, around the gutter and into the interior of the jacket. Ensuring that the opening 6 is unobstructed has the technical advantage of allowing air to freely flow through the open rig at all times. It also reduces the number of parts required for the construction of the vent, giving a simple and more easily manufactured vent than in the prior art discussed above.

Preferably the gutter also extends across at least the majority of the width of the vent.

Figure 6:
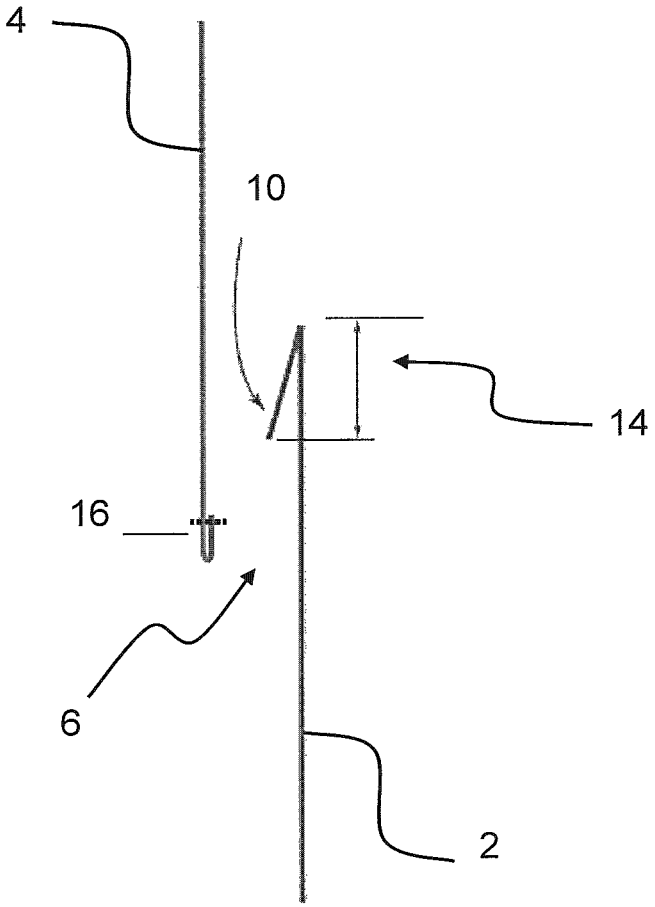
FIG. 6 illustrates a schematic view of the overlap between the lower end portion of the upper layer and the upper end portion of the lower layer, the gutter, and a hem on the lower end portion of the upper layer.

A schematic view of the overlap between the panels of an embodiment of the invention is illustrated in FIG. 6. Lower panel 2 and upper panel 4 are separated to form opening 6. At the upper end of the lower panel, the lower panel is folded towards the opening to create gutter 10. Preferably the gutter is a fold forming an acute angle of less than 85° more preferably less than 45°, even more preferably less than 30°. Preferably the end of the gutter is spaced from the panel across substantially the majority of the vent. However, it will be understood by the skilled person that when the garment is in active use by the user that the gutter may bend and the angle formed by the gutter will vary.

Preferably the gutter is not tacked, fixed or bonded to the lower or upper panels other than at its ends. This has the technical advantage of allowing the gutter to extend across the full width of the opening and prevent wind-blown rain from passing through the opening 6, whilst still allowing the passage of air flow 900.

The gutter length 14 is preferably at least 5 mm, more preferably at least 10 mm, and even more preferably at least 15 mm. Preferably the fold length 14 is at most 50 mm. In this example the lower end of the upper panel 4 has a hem 16. In this example the hem is stitched. The hem 16 preferably extends at least the entire width of the opening 6.

Figure 7:
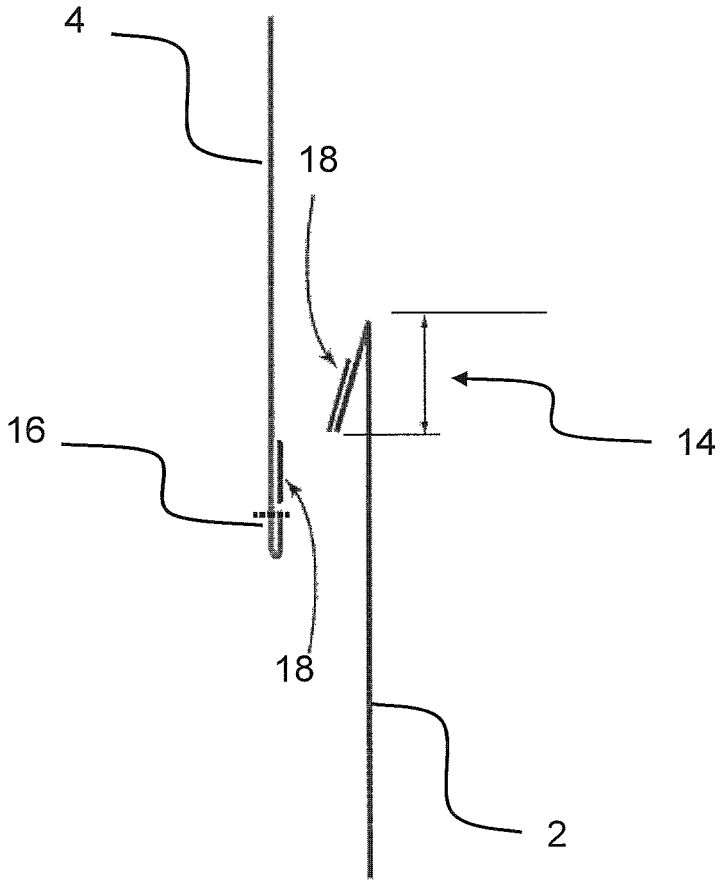
FIG. 7 illustrates a schematic view of the location of wicking barriers on the lower end portion of the upper layer and the upper end portion of the lower layer.

FIG. 7 illustrates the placement of wicking barriers 18 on the gutter 10 and the lower end of the upper panel in an embodiment of the invention. The wicking barriers also preferably extend at least the entire width of the opening and/or gutter.

Figure 8:
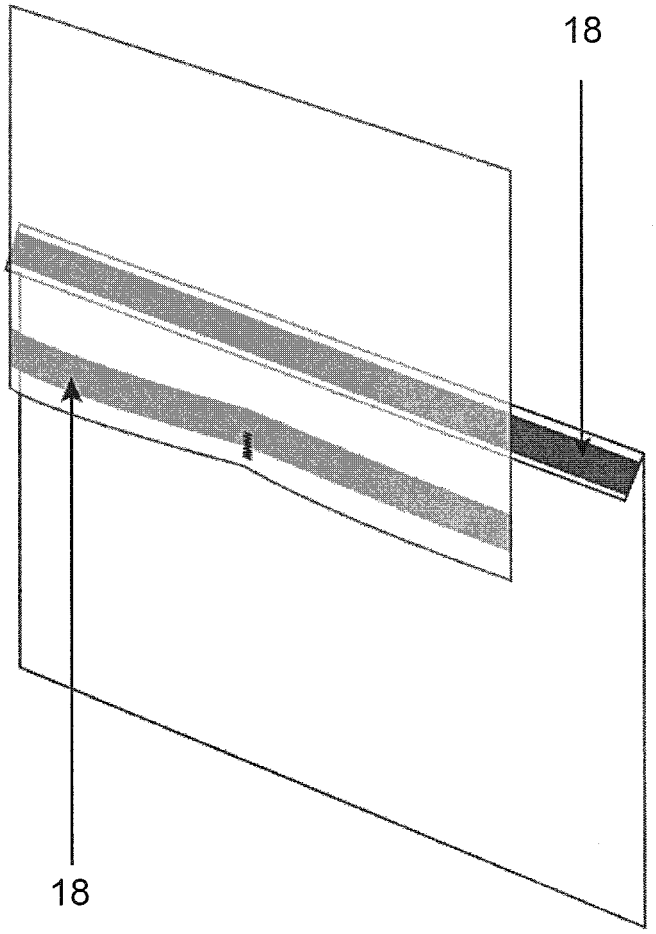
FIG. 8 illustrates a perspective view of the location of wicking barriers on the lower end portion of the upper layer and the upper end portion of the lower layer.

A perspective view of the placement of wicking barriers 18 on the gutter 10 and on the backer of the lower end of the upper panel in an embodiment of the invention is illustrated in FIG. 8. The skilled person will understand that wicking barriers may be located at other locations around the opening of the vent. It will also be understood that more than two wicking barriers may be used. The wicking barriers preferably extend at least the entire width of the opening. The wicking barriers may be made from e.g. pre-made tapes, PTFE, PU, TPU, silicon and rubber.

Figure 9:
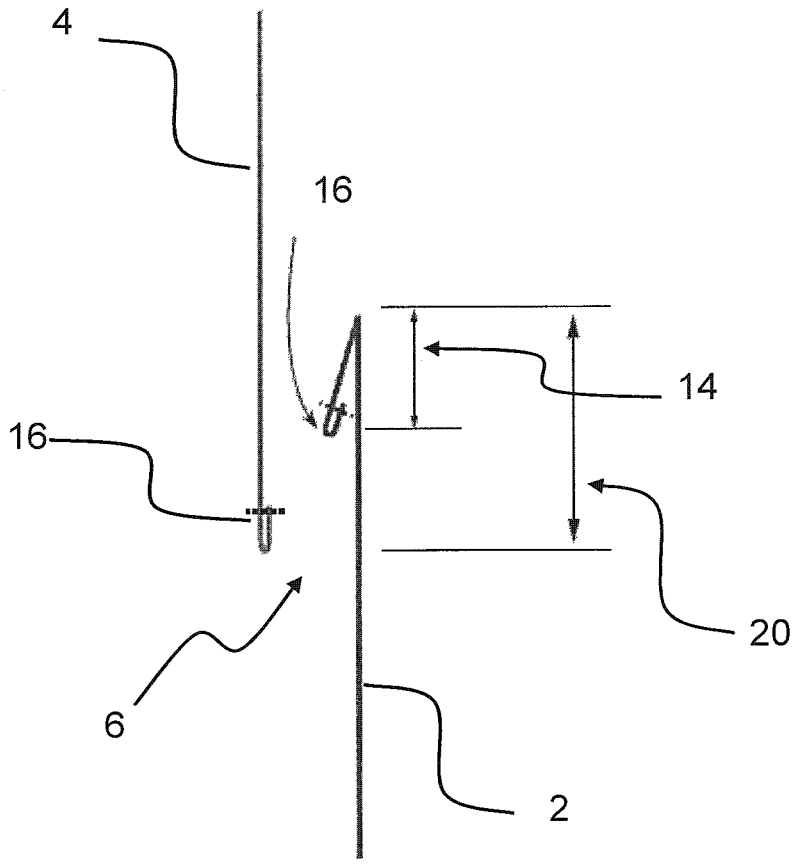
FIG. 9 illustrates a schematic view of the overlap between the lower end portion of the upper layer and the upper end portion of the lower layer, the gutter, and a hem on both the lower end portion of the upper layer and the gutter.

FIG. 9 illustrates a schematic view of an alternative embodiment of the invention. In this embodiment, both the lower end of the upper panel, and the gutter formed at the upper end of the lower panel, have a hem 16.

FIG. 9 also illustrates the length 20 of the overlap between the upper panel and the lower panel. Preferably the length 20 of the overlap is at least 30 mm, more preferably at least 40 mm, and even more preferably at least 50 mm. Preferably the length of the overlap is at most 250 mm. In some preferred aspects, the length 20 is uniform over the width of the opening 10. Alternatively the length 20 varies over the width of the opening 10.

Figure 10:
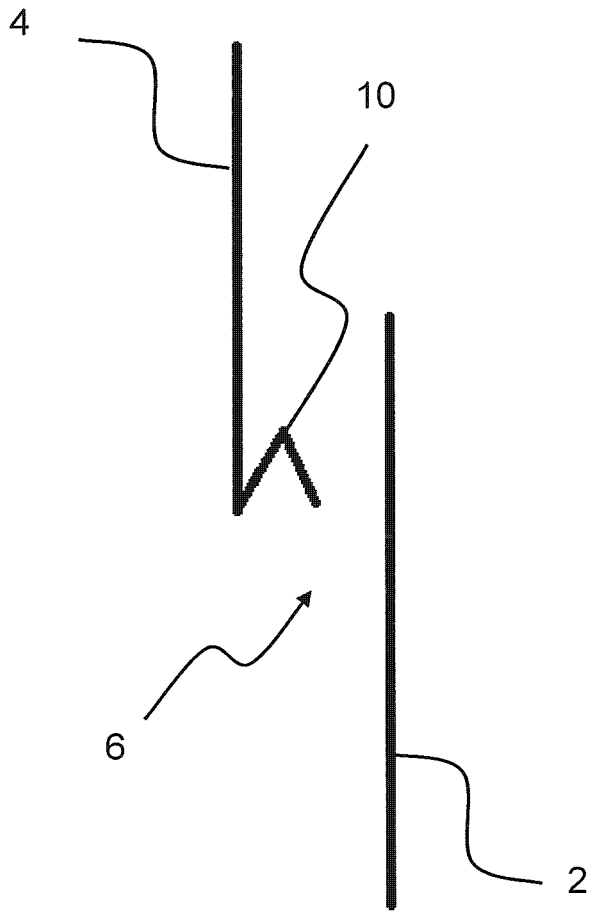
FIGS. 10-13 illustrate a schematic view of alternative gutter arrangements.
Figure 11:
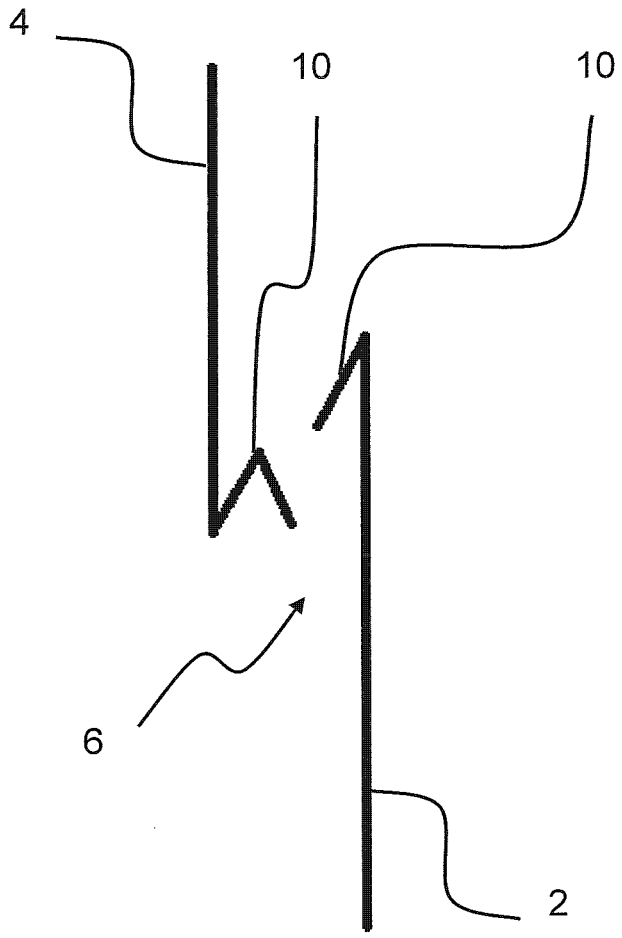
Figure 12:
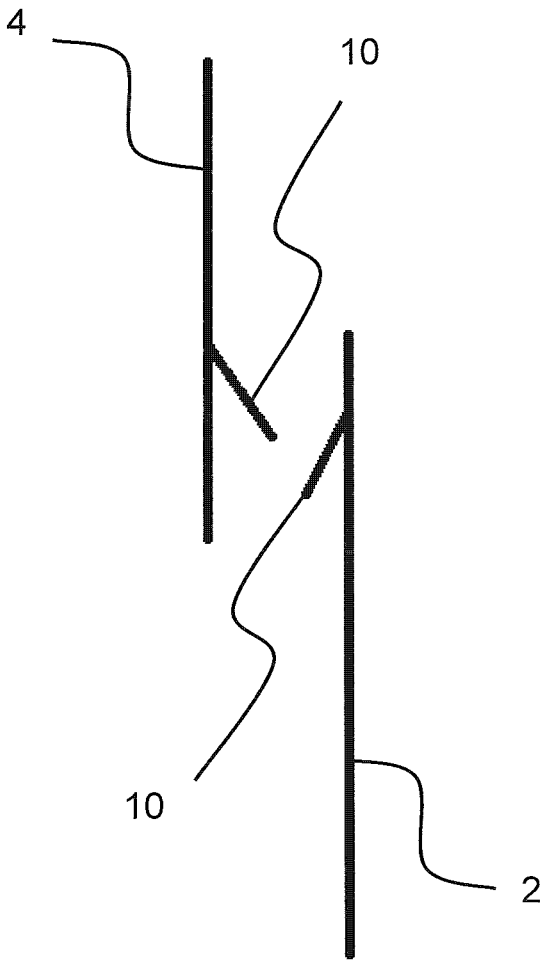

FIGS. 10-13 shown alternative embodiments of the invention, indicating different possible locations of the gutter within the opening of the vent. In FIG. 10 the vent has a gutter formed from a double fold in the lower end of the upper panel. In FIG. 11 the vent has two gutters, one formed from a fold in the upper end of the lower panel, and another formed from a double fold in the lower end of the upper panel. In FIG. 12 the vent has two gutters; these are both stitched or bonded onto either the upper end of the lower panel and/or the lower end of the upper panel.

Figure 13:
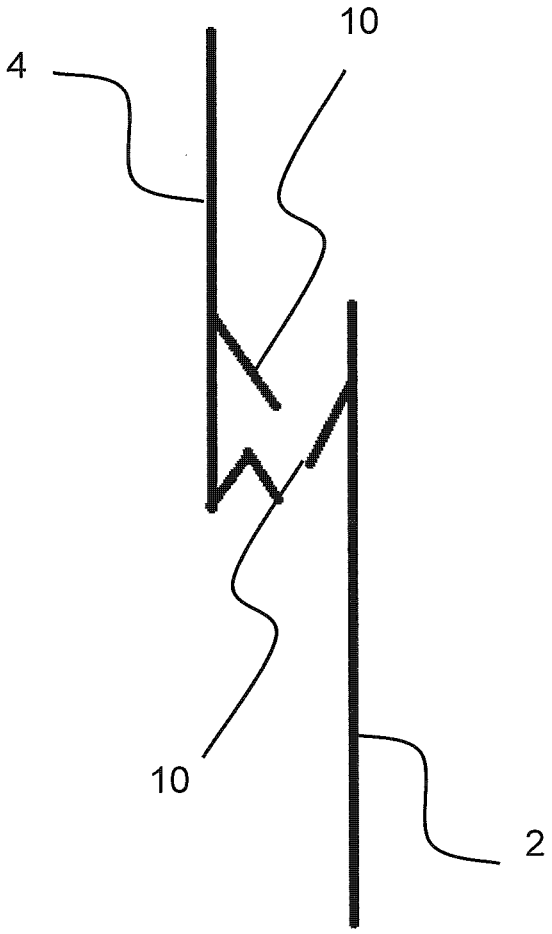

In FIG. 13 the vent has 3 gutters, one formed from a double fold in the lower end of the upper panel, and one gutter stitched or bonded to the upper panel and one gutter stitched or bonded to the lower panel. The skilled person will understand that different combinations of folding and stitching/bonding of gutters to the panels can be employed.

In another aspect, the invention comprises the entire passageway from the outside of the garment to the inside of the garment which may be referred to as a vent path, and the space between the overlapping panels may be referred to as a vent opening, the gutters being formed in the vent opening.

The skilled person will appreciate that various modifications to the specifically described embodiments are possible without departing from the invention.

The invention claimed is:

1. A garment comprising:

a vent path extending from an outside of the garment to an interior of the garment, an upper outer panel having a lower end portion, a lower inner panel having an upper end portion, the lower end portion of the upper outer panel overlapping the upper end portion of the lower inner panel so as to form a vent opening between the lower end portion and the upper end portion, a gutter formed as a downward fold from one of the panels, the gutter extending from the fold into the vent opening, the vent opening being opened above the upper end portion of the lower inner panel, an access opening from the vent opening into the interior of the garment, and wherein the vent path is unobstructed from the outside of the garment, through the vent opening, around the gutter and through the entire access opening into the interior of the garment, wherein the upper outer panel and the lower inner panel are operatively engaged with each other at opposite ends of the access opening, such that an air flow with a continuous width equal to an entire width of the access opening between the opposite ends of the access opening can pass through the access opening into the interior of the garment.

2. The garment of claim 1 wherein the gutter is on the upper end portion of the lower inner panel or the lower end portion of the upper outer panel.

3. The garment of claim 1 wherein the downward fold extends from the upper end portion of the lower inner panel.

4. The garment of claim 1 wherein at least one of the lower end portion of the upper outer panel and the upper end portion of the lower inner panel has a hem.

5. The garment of claim 1 wherein the upper outer panel and the lower inner panel are attached at discrete, spaced apart points.

6. The garment of claim 5 wherein the gutter is only stitched or bonded at the discrete, spaced apart points where the upper outer panel and the lower inner panel are attached.

7. The garment of claim 1 wherein the gutter extends partially or fully across a width of the vent opening.

8. The garment of claim 1 wherein the overlap forming the vent opening between the upper outer panel and the lower inner panel has a length of at least 30 mm.

9. The garment claim 1 wherein a length of the fold forming the gutter is at least 10 mm.

10. The garment of claim 1 wherein the gutter forms an acute angle of less than 85°.

11. The garment of claim 1 wherein at least one of the upper outer panel and lower inner panel has a wicking barrier on a surface facing the vent opening, the wicking barrier configured to prevent the ingress of moisture through the vent opening.

12. The garment according to claim 1, comprising a series of vent openings arranged parallel and one above the other to form a gill-like arrangement.

13. The garment according to claim 1, including a second gutter formed as a downward fold on a lower part of the upper outer panel, and extending away from the upper panel into the vent opening to trap water traveling through the vent opening.

14. The garment according to claim 1, wherein the gutter fold forms an angle of less than 45° with the panel from which the gutter is folded downwardly.

15. The garment according to claim 1, wherein the gutter is formed as a downward fold from the lower end portion of the upper outer panel.

* * * * *